US006092291A

United States Patent [19]

Cendoma

[11] Patent Number: 6,092,291

[45] Date of Patent: Jul. 25, 2000

[54] HELMET FACE-MASK EXTRACTOR

[76] Inventor: Michael J. Cendoma, P.O. Box 2561, Bangor, Me. 04402

[21] Appl. No.: 09/333,434

[22] Filed: Jun. 15, 1999

Related U.S. Application Data

[60] Provisional application No. 60/089,340, Jun. 15, 1998.

[51] Int. Cl.[7] ..... B26B 13/06

[52] U.S. Cl. ..... 30/254; 30/134

[58] Field of Search ..... 30/90.1, 131, 134, 30/254, 258, 278, 279.2, 289

[56] References Cited

U.S. PATENT DOCUMENTS

| | | | |
|---|---|---|---|
| 2,903,790 | 9/1959 | Klein, Jr. | 30/134 |
| 3,287,751 | 11/1966 | Hoffman | 30/134 |
| 3,461,555 | 8/1969 | Bliznak | 30/254 |
| 4,229,881 | 10/1980 | Troxel | 30/254 |
| 5,749,147 | 5/1998 | Hasegawa | 30/134 |

*Primary Examiner*—Hwei-Siu Payer
*Attorney, Agent, or Firm*—Thomas L. Bohan and Associates; Thomas L. Bohan

[57] ABSTRACT

A plier-like tool for removing a face mask from a protective sports helmet worn by an athlete in such a way as to minimize the risk of exacerbating an existing spinal injury. The tool has a buttress portion and a blade portion pivotally connected to each other. The blade portion has a sharpened blade which, upon application of pressure to hand grips, slices through the plastic clips that are normally used to attach such face masks to the helmet. The buttress portion includes a cut-out portion and transverse slot that engage the metal bars of the face mask to prevent the tool from slipping off the bars, and the blade portion includes a notch to ensure that the blade portion engages the plastic clips.

16 Claims, 2 Drawing Sheets

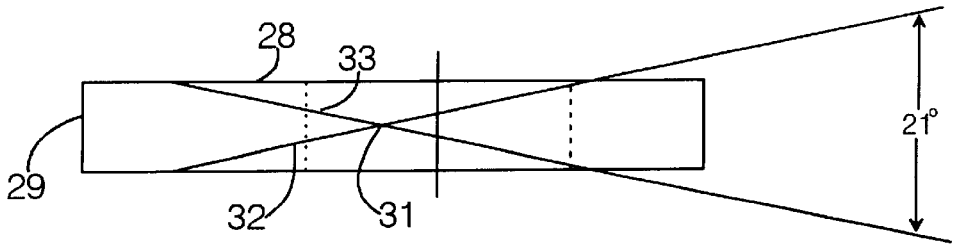
FIG. 8
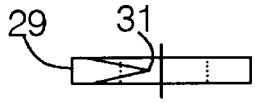
FIG. 7
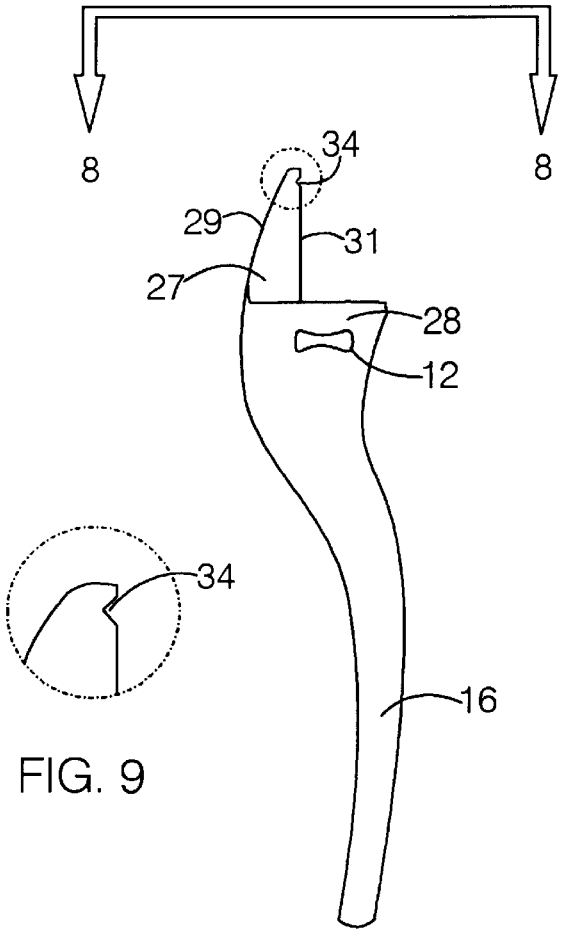
FIG. 9
FIG. 5
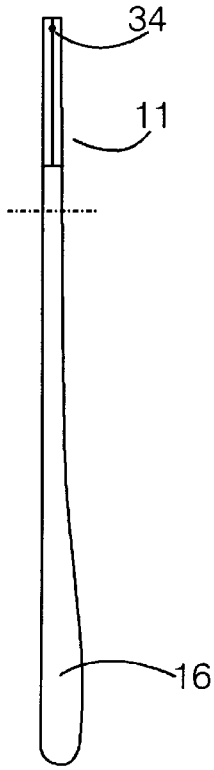
FIG. 6

HELMET FACE-MASK EXTRACTOR

CROSS-REFERENCE TO RELATED PROVISIONAL APPLICATION

This application claims the benefit of U.S. Provisional Application Ser. No. 60/089,340, filed on Jun. 15, 1998.

BACKGROUND OF THE INVENTION

1. Field of the Invention

The present invention relates to emergency removal of a face mask from a potentially spine-injured athlete's protective helmet to allow access to the athlete's airway. More specifically, the invention relates to a pliers type nipper tool for the cutting of the plastic face mask fastening clips which fasten the face mask to the protective helmet shell.

2. Description of the Prior Art

Potentially dangerous contact field sports such as hockey, football and lacrosse usually require the use of hard shell helmets for head protection which include plastic-covered metal-bar face masks for face protection. These masks are most usually connected to the hard shell helmet by means of plastic fastening systems which include plastic face mask fastening clips. The plastic clips are designed to be screw-threaded or otherwise attached to the helmet shell and encircle a portion of the rubber/plastic coated metal bars comprising the face mask. During on-field management of a potentially spine-injured athlete wearing such a helmet, it is imperative that the sports health care professional be able to gain immediate access to the athlete's airway without causing unnecessary movement within the vertebral column. If excessive pressure on the face mask is required to insure proper engagement of a cutting blade, the resultant tendency is to place a rotary force about the longitudinal axis of the injured player's vertebral column, which could have disastrous results. Unless the cutting tool for severing the face mask fastening clips is properly designed, the tool often slips off the metal face mask bars resulting in ineffective cutting of the plastic face mask clip. This occurrence usually results in excessive and potentially catastrophic rebound forces being applied to the vertebral column of the athlete wearing the helmet. It is thus apparent that a need exists for a reliable and effective tool for rapidly removing a face mask from the protective helmet of a potentially spine-injured athlete without creating further risks for injury. Although many in the sports medicine industry have called for such a tool, today, the primary approach has been in the nature of modifications to existing tools which are either not generally functional or whose use results in numerous concerns about their safe application.

Until recently, the most common expedient was to attempt modification of existing garden tools or hardware tools such as polyvinyl chloride (PVC) pipe cutters, anvil pruners, trauma shears or screwdrivers and high speed rotary tools to perform the task of cutting the plastic face mask fastening clips. The problem with this approach is that modifications to a specific existing tool adapts the tool for only a selected and limited number of instances, therefore requiring the health professional to carry several tools in order to be properly prepared. Generally speaking, this type of tool modification is impractical and ineffective.

Another tool which has been applied is the hand held battery operated blade saw (HHBS). The primary problem with the HHBS is its tendency to melt the plastic clips, resulting in a time consuming and ineffective release of the face mask. Still another attempt at a satisfactory tool is known as trainer's angles (TA), a straight-bladed cutter, which has also proved to be limited in its application and generally ineffective and inefficient for the purpose of obtaining a quick and clean release of the face mask. This tool was designed specifically for football helmets and is generally unworkable on other types of athletic helmets. The TA straight-blade surface used for cutting along a circular face mask bar results in a less than effective engagement, usually requiring a "backup" tool in order to finish the job. Additionally, excessive pressure is required in order to perform the cutting action, requiring significant grip strength on the part of the user, which also becomes a limitation. Sports health care professionals have a long-felt need for a reliable, efficient and effective single tool for engaging the plastic fastening clips and metal face mask bars. The tool should require no modifications and should be universal and thus applicable in all circumstances requiring removal of a face mask from a protective athletic helmet regardless of the fastening system.

SUMMARY OF THE INVENTION

The tool of the present invention is a pliers-type nipper tool having a low profile, sharp blade portion and a buttress portion constructed from high grade hardened steel, with the two cooperating portions being coupled by an intermediate slip pivot. The handle and slip pivot feature is typical of the pliers-type tool design. The blade portion has an associated notch—positioned distally from the gripping handle of the blade portion—for engaging the plastic clips that fasten the face mask to the protective athletic helmet. The buttress portion of the apparatus contains a semicircular projection or denticulation on its periphery and a slotted end wall—distal from the gripping handle of the buttress portion—for engagement with the rubber or plastic-coated metal bars comprising the face mask. The notch and denticulation oppose each other when the device is assembled. When these opposing portions are proximated or brought together, the blade portion slices through the plastic clip that fastens the face mask to the protective helmet shell. The low profile design allows the tool to fit into small areas bordered by adjacent face mask bars to cut the plastic clip at the midsection between the area where the clip is screwed into the protective helmet shell and the area of the clip that encircles the face mask bar. The associated denticulations of all the peripheral and superior aspects that allow it to engage the metal face mask bars increase the cutting effectiveness of the tool.

BRIEF DESCRIPTION OF THE DRAWINGS

FIG. 5 is a side elevational view of the blade portion of the tool.

FIG. 6 is an end elevational view of the blade portion of tool.

FIG. 7 is a top plan view of the blade portion of the tool.

FIG. 8 is an enlarged view similar to FIG. 7 taken along lines 8—8 of FIG. 5, illustrating the cutting edge of the sharpened blade.

FIG. 9 is an enlarged view of the circled area of the blade portion shown in FIG. 5.

DESCRIPTION OF THE PREFERRED EMBODIMENT

Figure 1:
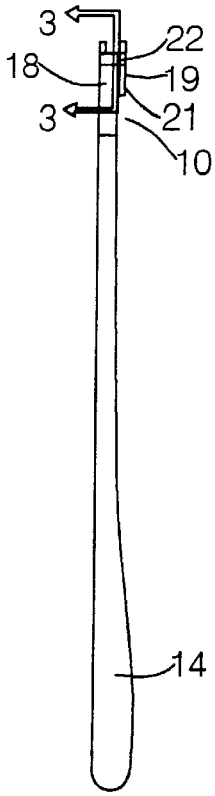
FIG. 1 is an end elevational view of the buttress portion of the tool.
Figure 2:
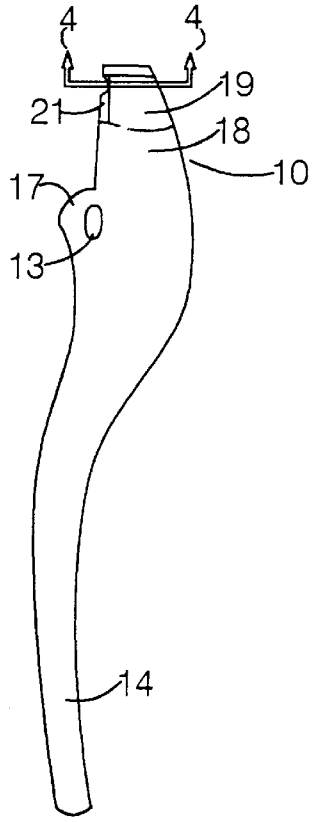
FIG. 2 is a side elevational view of the buttress portion of the tool.
Figure 4:
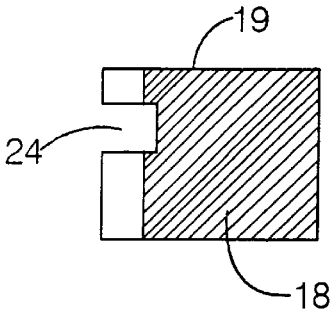
FIG. 4 is a cross sectional view taken along lines 4—4 of FIG. 2.

The pliers type tool of the present invention is a two-part assembly having a buttress portion indicated generally at 10 in FIG. 1 and FIG. 2 and a blade portion, indicated generally at 11 in FIG. 5 and FIG. 6. The two halves of the tool are joined or coupled by an intermediate slip pivot joint as is conventional with pliers-type tools and which will be well understood by those skilled in the art. The slip joint includes the usual elongated lobed slot 12 in the blade portion which cooperates with a pivot pin (not shown) engaged in the hole 13 in the buttress portion of the tool as shown in FIG. 5 and FIG. 2, respectively. This arrangement serves to adjust the purchase of the operating portion of the tool. Each half of the tool includes conventional gripping handles such as the handles 14 and 16, which are curved in a conventional manner and include hand gripping surfaces at their distal ends as shown in the drawings. The handles are configured such that, when the two halves are assembled, the handles curve toward one another to be gripped by the hand of the user.

Figure 3:
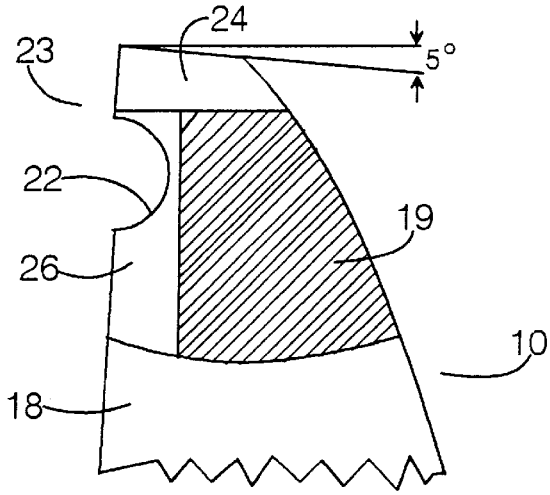
FIG. 3 is a partially sectioned view of the denticulated distal end of the buttress portion taken along lines 3—3 of FIG. 1.

Referring to FIGS. 1–4, the buttress portion 10 is a continuation of the tool above the body area 17 surrounding the pivot point 13. It will be understood that the gripping handle 14 and buttress portion 10 are of unitary construction and made from a high grade hardened steel to ensure sufficient strength to cut through clips that might be harder than usual due to, for example, cold weather or age. The buttress portion 10 includes a buttress body 18 with the distal end thereof having a laterally extending protrusion 19 integral therewith, all as shown in FIG. 1 through FIG. 4. The protrusion 19 has a working face 21 which is coincident with the working face of the buttress body 18 and includes a transverse semicircular cut-out 22. The cut-out extends across the working face of both the buttress body 18 and protrusion 19 as seen in FIG. 1. This cut-out forms a tooth-like structure or denticulation 23 on the end of the buttress portion 10 distal to the gripping handle 14. The denticulation 23 also includes a transverse slot 24 in its top surface for engagement of the rubber or plastic coated metal bars comprising the face mask. As illustrated in FIG. 3, the top surface of the distal end is angled downwardly from the vertical working face of the buttress in the arc of 5°. A wedge-shaped vertical groove 26 extends from the bottom side of the projection 19 upwardly and opens into the transverse slot 24 as shown in FIG. 3. As seen in FIG. 3, the vertical groove 26 widens at the top end of the buttress section as it intersects the slot 24. The cut-out portion 22 and transverse slot 24 are essential in insuring proper engagement of the metal bars of the face mask. Without these features, the buttress portion 10 is prone to slip off the metal face mask bars, resulting in ineffective cutting of the plastic face mask clip. This design offers a variety of options for engagement of the metal bars in the face mask and the plastic fastening clips which, since face mask designs are far from being standardized, is essential.

The blade portion 11 of the tool includes a cutter blade 27 extending upwardly from the portion of the blade body 28 surrounding the slip pivot 12. It will be understood that the blade portion 11 and associated gripping handle 16 are of unitary construction and made of high grade hardened steel to ensure cutting strength. The cutter blade 27 includes a back wall 29 and a straight vertical cutting edge 31 opposite the back wall 29. As seen most clearly in FIGS. 7 and 8, the cutting edge 31 of the cutter blade 27 is sharpened and, in the preferred embodiment, will include side faces 32 and 33, converging at an angle of approximately 21°, which has been determined to be ideal for severing the plastic clips. The outer or distal end of the cutter blade 27 includes a notch 34 as shown in FIG. 5 and in enlarged scale in FIG. 9. The notch 34 is shown as a 90° angle in the Preferred Embodiment but it will be understood that this angle may be varied within the scope and purview of this invention. When the tool is assembled by coupling the buttress portion 10 to the blade portion 11, the notch 34 opposes the denticulation 23.

The sharpened cutter blade 27 presents a low profile cutter which results in relatively low resistance as the cutter blade 27 moves through the plastic clip. Also, high grade hardened steel will allow a particularly sharp edge to be maintained on the blade portion 11, thus reducing the grip strength and/or hand size required on the part of the user. Also, the low-profile design allows the tool to fit into small areas bordered by adjacent face mask bars to cut the plastic clip at the midsection, between the area where the clip is screwed into the protective helmet shell and the area of the clip that encircles the face mask bar.

The notch 34 on the distal end of the blade is essential to ensure adequate engagement of the cutting edge 31 on the plastic face mask fastening clips of the protective athletic helmet. When the opposing portions of the tool are brought together, the blade portion 10 slices through the plastic clips that fasten the face mask to the protective helmet shell until the cutting edge 31 comes into contact with the back side of the projection 19 along the ledge formed by the vertical groove 26 and the back side. Without the notch 34, the cutter blade 27 can fail to cut through the entire thickness of the clip. With the blade portion 11 and buttress portion 10 configured as described, the tool has many options for engaging the plastic fastening clips and metal face mask bars. Sports health care professionals do not need to make any modifications to the tool and they can be confident that all circumstances requiring removal of a face mask from any protective athletic helmet involving plastic fastening systems can be handled with the tool of the present invention.

It is to be understood that the foregoing description of the Preferred Embodiment and the accompanying drawings have been given by way of illustration and example. It is also to be understood that changes in form of the several parts, substitution of equivalent elements and arrangement of parts which will be readily apparent to one skilled in the art are contemplated as within the scope of the present invention.

I claim:

1. A face-mask extractor comprising:

a) a buttress portion having a gripping handle, a buttress body, and a laterally extending protrusion distal to said gripping handle, said laterally extending protrusion having a working face coincident to a buttress body working face, a transverse semicircular cut-out extending across said working face and said buttress body working face, said transverse semicircular cut-out forming a denticulation on a distal end of said buttress portion;

b) a blade portion, said blade portion including a blade-gripping handle, a blade body portion, and a cutter blade distal to said blade-gripping handle, said cutter blade having a back wall and a straight vertical cutting edge opposite said back wall, said vertical cutting edge having two side faces converging at an angle and a distal end of said cutter blade having a notch thereon; and c) a slip pivot joint, said slip pivot joint including a pivot pin engaging a cylindrical opening in said buttress body and an elongated slot in said blade body portion such that said transverse semicircular cut-out opposes said vertical cutting edge.

2. The face-mask extractor as claimed in claim 1 wherein said denticulation further includes a transverse slot disposed on a top surface of said denticulation, said transverse slot being capable of engaging a bar of a face-mask.

3. The face-mask extractor as claimed in claim 2 wherein said top surface forms a downward angle with said buttress body working face.

4. The face-mask extractor as claimed in claim 3 wherein said downward angle is 5°.

5. The face-mask extractor as claimed in claim 2 further comprising a vertical groove, said vertical groove being wedge-shaped and extending along said laterally extending protrusion and intersecting said transverse slot.

6. The face-mask extractor as claimed in claim 1 to wherein said angle is 21°.

7. The face-mask extractor as claimed in claim 1 wherein said blade portion and said buttress portion are fabricated from hardened steel.

8. A tool adapted to remove a face-mask from a protective helmet, said tool comprising:

a) a buttress portion, said buttress portion including a buttress-gripping handle, a buttress body, said buttress body having a working face, and a protrusion on an end distal to said buttress-gripping handle, said protrusion extending laterally and including a cut-out portion, said cut-out portion forming a denticulation at a distal end of said protrusion, and a transverse slot disposed on a top surface of said denticulation; and b) a blade portion, said blade portion being pivotally coupled to said buttress portion and having a blade-gripping handle, a blade body, and a cutter blade distal to said blade-gripping handle, said cutter blade having a cutting edge and a notch located on a distal end of said cutter blade, such that said cut-out portion opposes said cutting edge.

9. The tool as claimed in claim 8 wherein said buttress portion is coupled to said blade portion by a slip pivot joint, said slip pivot joint including a pivot pin engaging a cylindrical opening in said buttress body and an elongated slot in said blade body.

10. The tool as claimed in claim 8 wherein said blade portion and said buttress portion are fabricated from hardened steel.

11. The tool as claimed in claim 8 wherein said cutting edge is sharpened and includes two side faces, said side faces converging at a cutting angle.

12. The tool as claimed in claim 11 wherein said cutting angle is 21°.

13. The tool as claimed in claim 8 wherein said top surface forms a downward angle with said buttress body working face.

14. The tool as claimed in claim 13 wherein said downward angle is 5°.

15. The tool as claimed in claim 8 wherein said buttress-gripping handle, said buttress body, and said protrusion are of unitary construction.

16. The tool as claimed in claim 8 wherein said blade-gripping handle, said blade body, and said cutter blade are of unitary construction.

* * * * *